US010395564B2

(12) United States Patent
Komeha et al.

(10) Patent No.: US 10,395,564 B2
(45) Date of Patent: Aug. 27, 2019

(54) AUTOMOTIVE SERVICE TAG AND METHOD OF USING THE SAME

(71) Applicant: Auto Service Tags, LLC, Chevy Chase, MD (US)

(72) Inventors: Sameh Komeha, Chevy Chase, MD (US); Sayed Saied Hussein, Valencia, CA (US); Paul Berman, Santa Monica, CA (US)

(73) Assignee: Auto Service Tags, LLC, Chevy Chase, MD (US)

( * ) Notice: Subject to any disclaimer, the term of this patent is extended or adjusted under 35 U.S.C. 154(b) by 0 days.

(21) Appl. No.: 16/059,429

(22) Filed: Aug. 9, 2018

(65) Prior Publication Data

US 2019/0051218 A1 Feb. 14, 2019

Related U.S. Application Data

(60) Provisional application No. 62/543,632, filed on Aug. 10, 2017.

(51) Int. Cl.
*G09F 3/02* (2006.01)
*G09F 21/04* (2006.01)
(Continued)

(52) U.S. Cl.
CPC ..... *G09F 3/02* (2013.01); *G09F 21/04* (2013.01); *A44B 15/005* (2013.01); *G09F 2007/1865* (2013.01)

(58) Field of Classification Search
USPC ..... 40/364, 359
See application file for complete search history.

(56) References Cited

U.S. PATENT DOCUMENTS 2,374,695 A * 5/1945 Murray ..... B42F 19/00 40/359
2,556,825 A 6/1951 Smith
(Continued)

OTHER PUBLICATIONS

<URL: http://www.watdasi.com/mirrortagsystem.aspx>, Wisconsin Auto Truck Dealers Association Services Incorporated, copyright 2018, 2 pages.

(Continued)

*Primary Examiner* — Kristina N Junge
(74) *Attorney, Agent, or Firm* — Sheppard Mullin Richter & Hampton LLP

(57) ABSTRACT

Disclosed is a generally planar automotive service tag, and method of using the same, having a first portion and a second portion. The first portion includes multiple foldable tags for describing service information, wherein each of multiple foldable tags fold and unfold along a foldable edge of the first end to indicate a status of a corresponding vehicle service. Each of the foldable tags has a male portion at a second end. The second portion of the automotive service tag includes an identifier for identifying the automotive service tag, and a plurality of female portions for each corresponding male portion of the plurality of foldable tags. The second portion further includes a protrusion that extends along an edge of a top end and a hanger portion that extends from the top end, the hanger portion being used to hang the automotive service tag on the rear-view mirror of a vehicle.

12 Claims, 10 Drawing Sheets

(51) Int. Cl.
*A44B 15/00* (2006.01)
*G09F 7/18* (2006.01)

(56) References Cited

U.S. PATENT DOCUMENTS

| | | | | |
|---|---|---|---|---|
| 2,957,261 | A | 10/1960 | Moskowitz | |
| 3,150,296 | A | 9/1964 | McIntosh | |
| 3,237,327 | A | 3/1966 | Griggs | |
| 3,508,356 | A | 4/1970 | Ross | |
| 3,531,880 | A | 10/1970 | Ramee | |
| 3,670,438 | A | 6/1972 | Carroll | |
| 3,802,107 | A | 4/1974 | Kemp | |
| 3,826,026 | A | 7/1974 | Bevan | |
| 4,190,151 | A * | 2/1980 | Russell | B65D 73/0071 206/281 |
| 4,207,697 | A | 6/1980 | Murphy | |
| 4,530,177 | A | 7/1985 | Kane | |
| 4,592,157 | A | 6/1986 | Kerr | |
| 5,498,859 | A | 3/1996 | Farmont | |
| 5,691,012 | A | 11/1997 | Suchko | |
| 5,868,498 | A | 2/1999 | Martin | |
| 5,915,330 | A | 6/1999 | Courville | |
| 6,430,854 | B1 | 8/2002 | Szentgyorgyi | |
| 7,225,568 | B1 | 6/2007 | Rizzo | |
| 7,246,459 | B2 | 7/2007 | Lewis | |
| 7,373,749 | B1 | 5/2008 | Lewis | |
| 7,774,969 | B1 * | 8/2010 | Silverman | H05K 5/0278 224/257 |
| 8,024,882 | B2 * | 9/2011 | Kelley | B42F 21/06 283/41 |
| 8,220,188 | B1 | 7/2012 | Keller | |
| 8,424,915 | B2 | 4/2013 | Haag | |
| 8,857,085 | B1 | 10/2014 | Lewis | |
| 2002/0133992 | A1 | 9/2002 | Wu | |
| 2004/0016160 | A1 | 1/2004 | Hudgins | |
| 2004/0148830 | A1 | 8/2004 | Baskerville | |
| 2007/0126226 | A1 | 6/2007 | Kolodzie | |
| 2007/0175076 | A1 | 8/2007 | Stanley | |
| 2007/0234615 | A1 | 10/2007 | Pendzich | |
| 2008/0067177 | A1 | 3/2008 | Cormack | |
| 2008/0196284 | A1 | 8/2008 | Stagg | |
| 2009/0013573 | A1 | 1/2009 | Krinke | |
| 2011/0154705 | A1 | 6/2011 | Gardiner | |
| 2011/0314713 | A1 | 12/2011 | Massaad | |
| 2011/0315569 | A1 * | 12/2011 | Haag | G09F 3/08 206/38 |
| 2012/0061472 | A1 | 3/2012 | Luongo, Jr. | |

OTHER PUBLICATIONS

<URL: https://graphicresourcesinc.com/>, Graphic Resources Inc., copyright 2017, 3 pages.

GR-78 Mirror Tag System, printed from <URL: http://www.gr78.com/>, GR-78.com, copyright 2015-2016, 2 pages.

PromoTAG In-Vehicle Advertising, printed from <URL: https://reyrey.com/rds-ecatalog/html/index.html?page=12>, The Reynolds & Reynolds Company, copyright 2016, pp. 10-12.

* cited by examiner

AUTOMOTIVE SERVICE TAG AND METHOD OF USING THE SAME

RELATED APPLICATIONS

This application claims priority to U.S. Provisional Patent Application Ser. No. 62/543,632, filed on Aug. 10, 2017, entitled "AUTOMOTIVE SERVICE TAG AND METHOD OF USING THE SAME," the contents of which is hereby incorporated by reference in its entirety herein.

FIELD OF THE INVENTION

The present invention relates to the field of vehicle identification and, in particular, to reusable tags for vehicles being serviced. More particularly, the present invention relates to a method and system of automotive service tag used to identify vehicle and to describe service information.

BACKGROUND

When a vehicle is serviced, it is a common practice to hang a disposable service tag on the rear-view mirror of the vehicle that has been left for service by the vehicle owner. The disposable service tag is used to identify the vehicle and to summarize the service that is being performed on the vehicle. In addition, the disposable service tag may have a key tag that identifies the ignition key and the vehicle owner to the corresponding vehicle.

Systems and methods for displaying vehicle identifying information are described, for example, in U.S. Pat. Nos. 8,857,085; 8,220,188; 7,373,749; 7,246,459; 7,225,568; 5,915,330; 5,691,012; 3,508,356; 3,150,296; 2,957,261, in U.S. Published Application Nos. 2009/0013573, 2007/0234615, 2008/0067177, 2004/0148830, 2004/0016160, and available at http://www.watdasi.com/mirrortagsystem-.aspx. In general, these systems use disposable tags for vehicle identification by parking and servicing businesses. These disposable tags, generally made from paper, generate a lot of waste and therefore, such use by the parking and servicing businesses isn't environment friendly.

A reusable automotive service tag would help reduce waste to the service provider and reduce the cost of obtaining new service tags for each automobile to be serviced. Accordingly, the need exists for a reusable automotive service tag, and a method of using the same.

SUMMARY

The present invention overcomes the disadvantages of the prior art and fulfills the needs noted above by providing a system and method for an automotive service tag.

More specifically, the present invention includes an automotive service tag having an upper portion and a lower portion, and is generally planar. The lower portion includes a plurality of foldable tags for describing service information, wherein each of the plurality of foldable tags fold and unfold along a foldable edge of the first end. Further, each of the plurality of foldable tags has a male portion at a second end. The upper portion of the automotive service tag includes an identifier for identifying the automotive service tag, and a plurality of female portions for each corresponding male portion of the plurality of foldable tags.

The upper portion further includes a protrusion that extends along an edge of a top end and a hanger portion that extends from the top end, the hanger portion being used to hang the automotive service tag on the rear-view mirror of a vehicle.

The present invention further includes an automotive service tag having a right-side portion and a left-side portion, and is generally planar. The left-side portion includes a plurality of foldable tags for describing service information, wherein each of the plurality of foldable tags fold and unfold along a foldable edge of the first end. Further, each of the plurality of foldable tags has a male portion at a second end. The right-side portion of the automotive service tag includes an identifier for identifying the automotive service tag, and a plurality of female portions for each corresponding male portion of the plurality of foldable tags. The right-side portion further includes a protrusion that extends along an edge of a top end and a hanger portion that extends from the top end, the hanger portion being used to hang the automotive service tag from the rear-view mirror of a vehicle.

The present invention further includes an automotive service tag having a left-side portion and a right-side portion, and is generally planar. The right-side portion includes a plurality of foldable tags for describing service information, wherein each of the plurality of foldable tags fold and unfold along a foldable edge of the first end. Further, each of the plurality of foldable tags has a male portion at a second end. The left-side portion of the automotive service tag includes an identifier for identifying the automotive service tag, and a plurality of female portions for each corresponding male portion of the plurality of foldable tags. The left-side portion further includes a protrusion that extends along an edge of a top end and a hanger portion that extends from the top end, the hanger portion being used to hang the automotive service tag from the rear-view mirror of a vehicle.

The present invention further includes a key tag, the key tag including a ring and a tag portion, wherein the tag portion has an identifier matching the identifier of the automotive service tag. The tag portion further includes a first end and a second end, with the ring being detachably attached to the first end of the tag portion and the tag portion having a through hole near the second end.

The present invention includes a method of using the automotive service tag when a vehicle is serviced. The method includes the steps of providing an automotive service tag as described above; hanging the automotive service tag with an identifier on the rear-view mirror of the vehicle using the hanger portion; hanging a key tag on the protrusion of the automotive service tag, the key tag having the same identifier as the automotive service tag; identifying the plurality of services that need to be performed on the vehicle; readying the vehicle for service by folding the plurality of foldable tags for services that do not need to be performed by inserting the male portion of the foldable tag into the corresponding female portion in the upper portion; and performing the service described in each of the plurality of foldable tags and subsequent to performance of each such described service, folding the corresponding foldable tag by inserting the male portion of the foldable tag into the corresponding female portion in the upper portion.

The present invention includes a method of using the automotive service tag when a vehicle is serviced. The method includes the steps of providing an automotive service tag as described above; hanging the automotive service tag with an identifier on the rear-view mirror of the vehicle using the hanger portion; hanging a key tag on the protrusion of the automotive service tag, the key tag having the same identifier as the automotive service tag; identifying the plurality of services that need to be performed on the vehicle; readying the vehicle for service by folding the plurality of foldable tags for services that do not need to be performed by inserting the male portion of the foldable tag into the corresponding female portion in the left-side portion; and performing the service described in each of the plurality of foldable tags and subsequent to performance of each such described service, folding the corresponding foldable tag by inserting the male portion of the foldable tag into the corresponding female portion in the left-side portion.

The present invention includes a method of using the automotive service tag when a vehicle is serviced. The method includes the steps of providing an automotive service tag as described above; hanging the automotive service tag with an identifier on the rear-view mirror of the vehicle using the hanger portion; hanging a key tag on the protrusion of the automotive service tag, the key tag having the same identifier as the automotive service tag; identifying the plurality of services that need to be performed on the vehicle; readying the vehicle for service by folding the plurality of foldable tags for services that do not need to be performed by inserting the male portion of the foldable tag into the corresponding female portion in the right-side portion; and performing the service described in each of the plurality of foldable tags and subsequent to performance of each such described service, folding the corresponding foldable tag by inserting the male portion of the foldable tag into the corresponding female portion in the right-side portion.

Other features and advantages of the present invention will become apparent from the following description of the invention, which refers to the accompanying drawings.

DETAILED DESCRIPTION

Disclosed embodiments relate to systems and methods for automotive service tag 100*s*.

Figure 1:
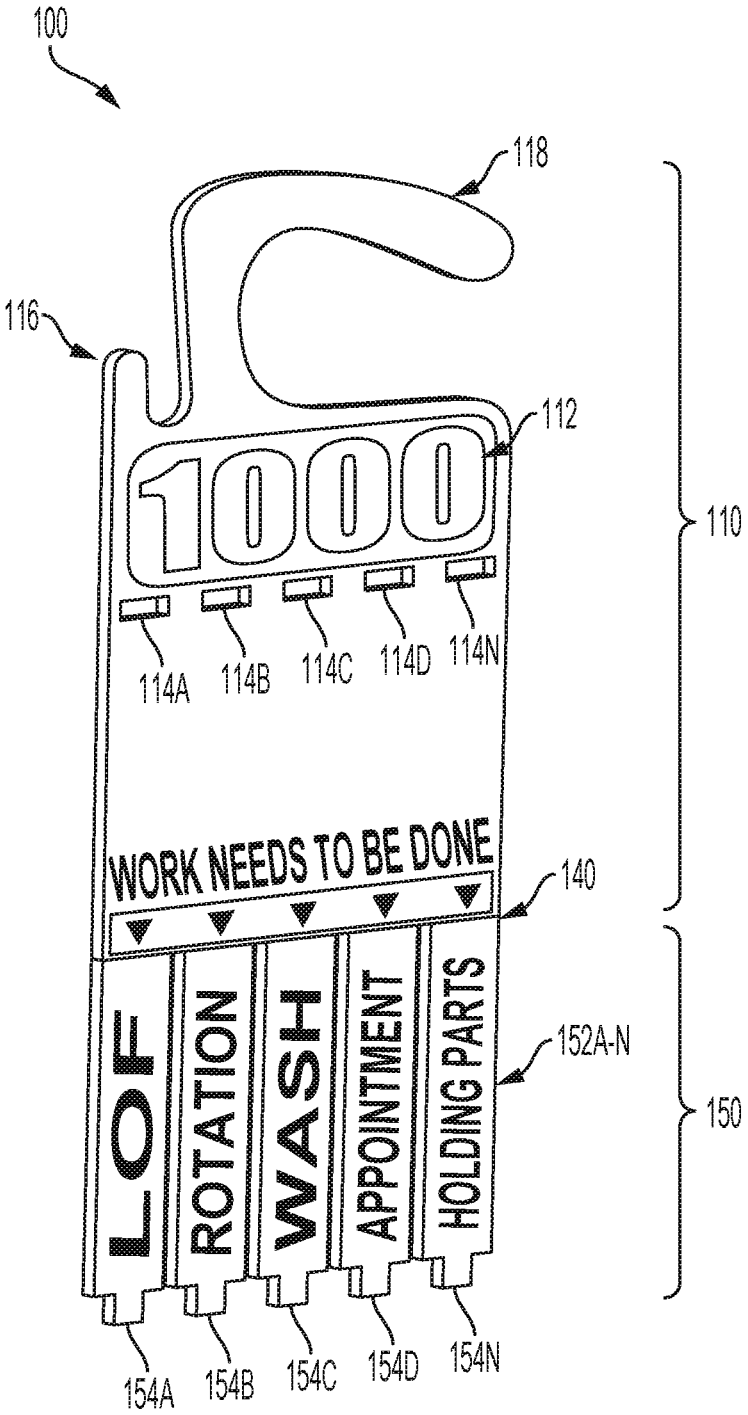
FIG. 1 shows the perspective view of an automotive service tag in accordance with an embodiment of the present invention.

Referring now to the drawings, where like elements are designated by like reference numerals, FIG. 1 illustrates a perspective view of the automotive service tag 100. The automotive service tag 100 is generally planar. The automotive service tag 100 has an upper portion 110 and a lower portion 150. The lower portion 150 includes a plurality of foldable tags 152A-N for describing service information. Each of the plurality of foldable tags 152A-N fold and unfold along a foldable edge 140 at the first end. Further, each of the plurality of foldable tags 152A-N has a male portion 154A-N at a second end. The upper portion 110 of the automotive service tag 100 includes an identifier 112 for identifying the automotive service tag 100. The upper portion 110*s* also has a plurality of female portion 114A-Ns 114A-N for each corresponding male portion 154A-N of the plurality of foldable tags 152A-N. The upper portion 110 further includes a protrusion (key tag male portion) 116 that extends along an edge of a top end and a hanger portion 118 that extends from the top end. The hanger portion 118 is used to hang the automotive service tag 100 on the rear-view mirror of a vehicle.

The automotive service tag 100 is made out of a reusable sheet material that is preferably printable. In a embodiment, the automotive service tag 100 may be formed, for example, of polyethylene or polypropylene.

Figure 2:
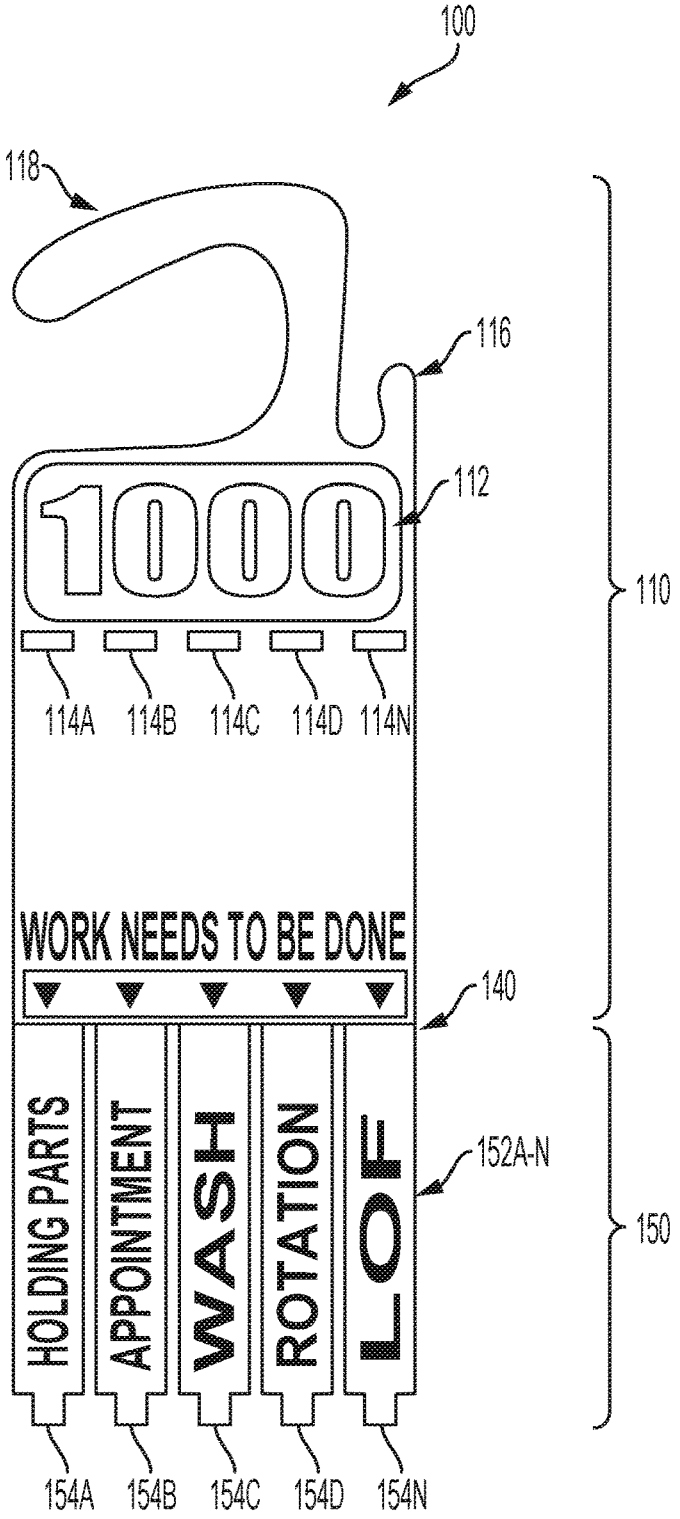
FIG. 2 shows the front side of an automotive service tag in accordance with an embodiment of the present invention.
Figure 3:
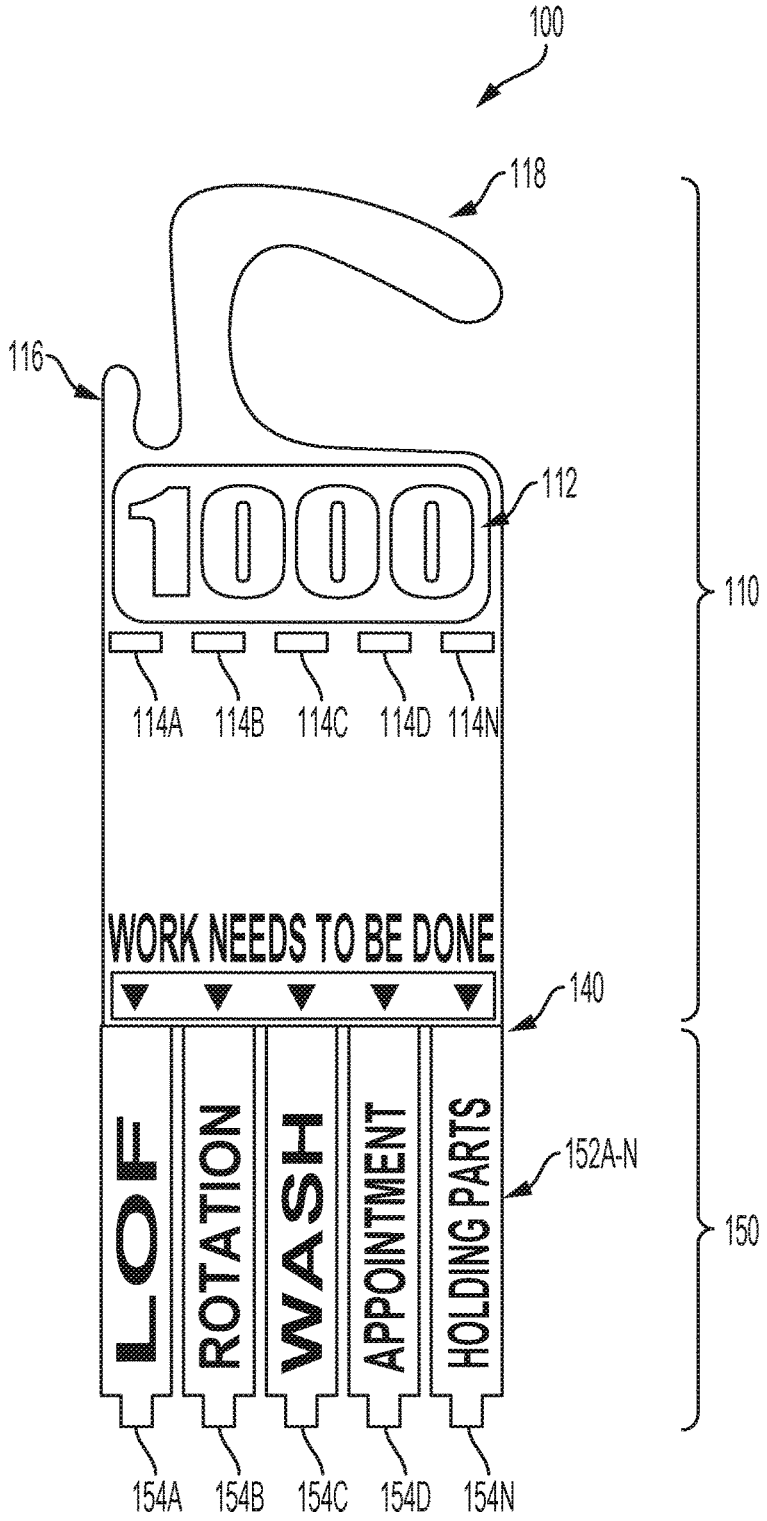
FIG. 3 shows the back side of an automotive service tag in accordance with an embodiment of the present invention.

Referring to FIGS. 2-3, showing the front and back side of the automotive service tag 100 respectively, the foldable tags 152A-N may include the description of the services to be performed on the vehicle. These descriptions may include, for example, holding parts, appointment, wash, rotation, or LOF.

Figure 4A:
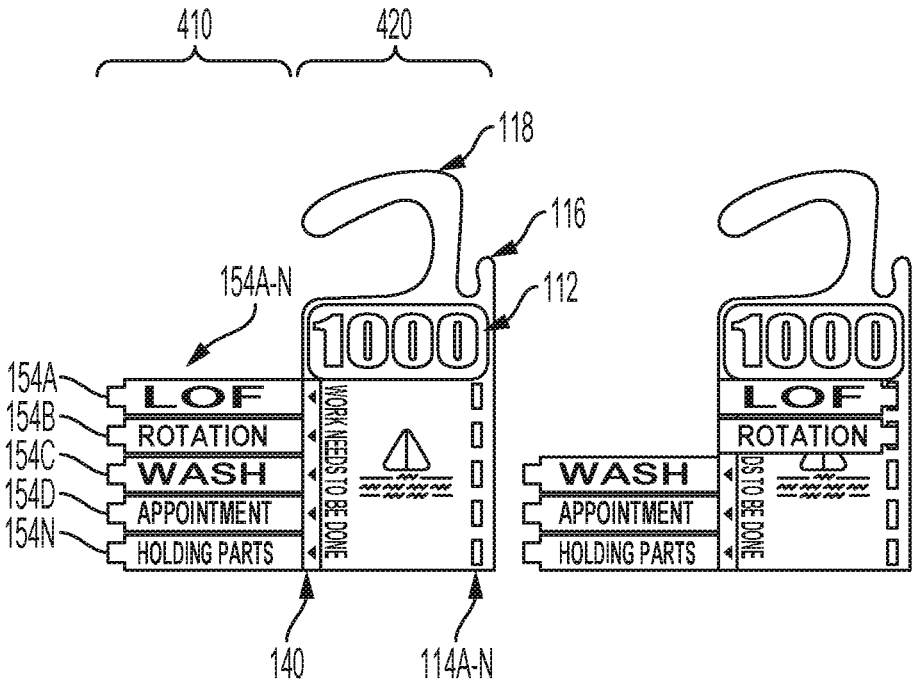
FIG. 4A shows the front side of an automotive service tag in accordance with another embodiment of the present invention.

In another embodiment, as shown in FIG. 4A, the front side of an automotive service tag 100 includes having a right-side portion 450 and a left-side portion 410. The automotive service tag 100 is generally planar. The left-side portion 410 includes a plurality of foldable tags 152A-N for describing service information. Each of the plurality of foldable tags 152A-N fold and unfold along a foldable edge 140 at the first end.

Further, each of the plurality of foldable tags 152A-N has a male portion 154A-N at a second end.

The right-side portion 450 of the automotive service tag 100 includes an identifier 112 for identifying the automotive service tag 100, and a plurality of female portion 114A-Ns 114A-N for each corresponding male portion 154A-N of the plurality of foldable tags 152A-N. The right-side portion 450 also includes a protrusion (key tag male portion) 116 that extends along an edge of a top end and a hanger portion 118 that extends from the top end. The hanger portion 118 is used to hang the automotive service tag 100 from the rear-view mirror of a vehicle.

The automotive service tag 100 is made out of a reusable sheet material that is preferably printable. In a embodiment, the automotive service tag 100 may be formed, for example, of polyethylene or polypropylene.

Figure 4B:
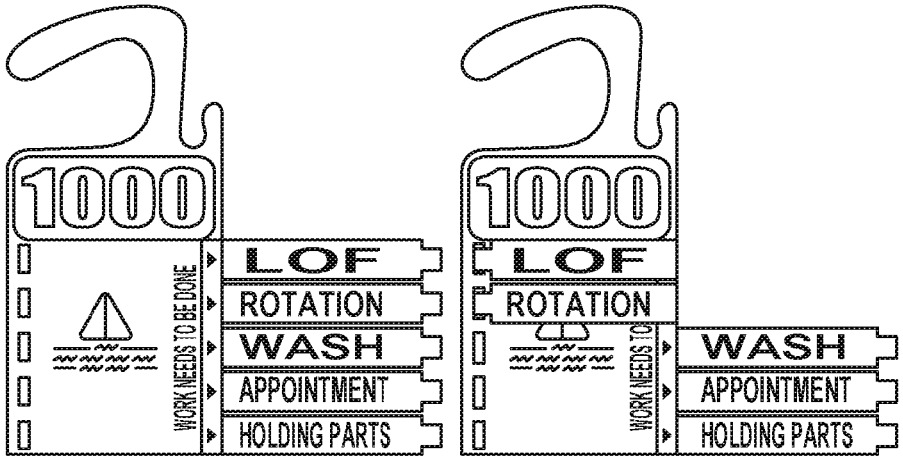
FIG. 4B shows the front side of an automotive service tag in accordance with another embodiment of the present invention.

In another embodiment, as shown in FIG. 4B, the front side of an automotive service tag 100 includes a left-side portion 410 and a right-side portion 450. The automotive service tag 100 is generally planar. The right-side portion 450 includes a plurality of foldable tags 152A-N for describing service information. Each of the plurality of foldable tags 152A-N fold and unfold along a foldable edge 140 at the first end.

Further, each of the plurality of foldable tags 152A-N has a male portion 154A-N at a second end. The left-side portion 410 of the automotive service tag 100 includes an identifier 112 for identifying the automotive service tag 100, and a plurality of female portion 114A-Ns 114A-N for each corresponding male portion 154A-N of the plurality of foldable tags 152A-N. The left-side portion 410 further includes a protrusion (key tag male portion) 116 that extends along an edge of a top end and a hanger portion 118 that extends from the top end. The hanger portion 118 is used to hang the automotive service tag 100 from the rear-view mirror of a vehicle.

The automotive service tag 100 is made out of a reusable sheet material that is preferably printable. In a embodiment, the automotive service tag 100 may be formed, for example, of polyethylene or polypropylene.

Figure 5:
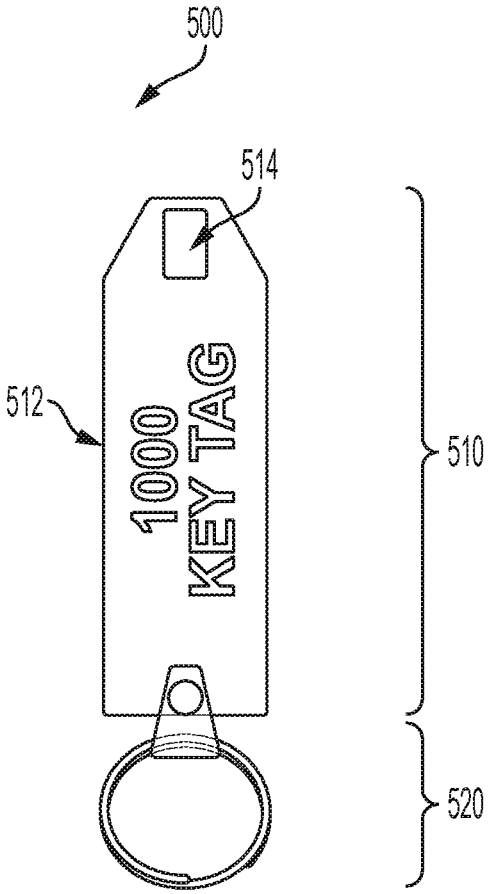
FIG. 5 shows the front side of a key tag in accordance with another embodiment of the present invention.

In a embodiment, as shown in FIG. 5, the front side of a key tag 500 includes a ring portion 520 and a tag portion 510 with an identifier 512 matching the identifier 112 of the automotive service tag 100. The tag portion 510 has a first end and a second end. The ring portion 520 may be detachably attached to the first end of the tag portion 510 and the tag portion has a through hole (female portion) 514 near the second end for receiving the protrusion (key tag male portion) 116 of the automotive service tag 100. The key tag 500 may be formed, for example, of polyethylene or polypropylene.

Figure 6:
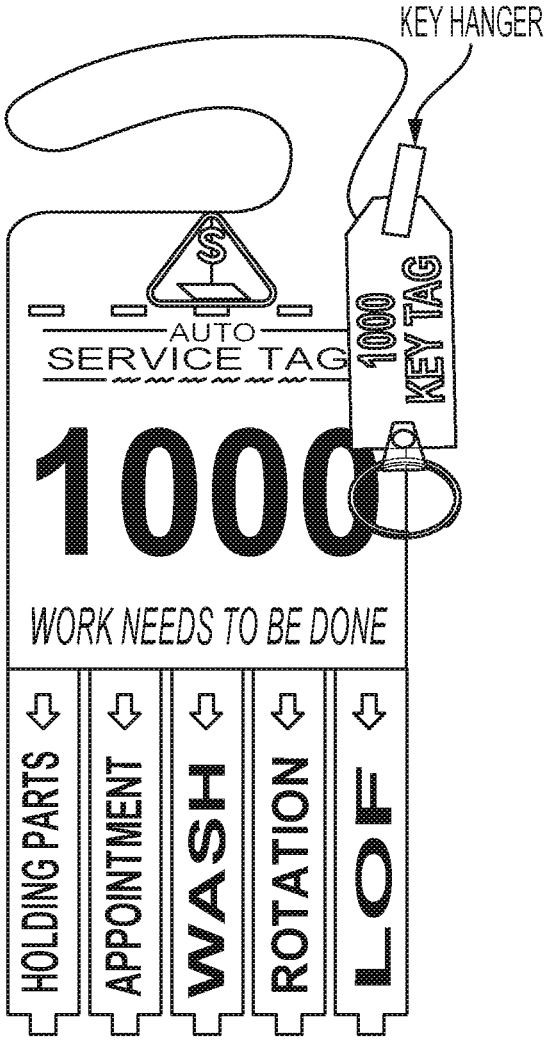
FIG. 6 shows the front side of an automotive service tag and a key tag in accordance with another embodiment of the present invention.

In a embodiment, as shown in FIG. 6, the key tag is hung on the automotive service tag 100 by inserting the through hole of the key tag into the protrusion (key tag male portion) 116 of the automotive service tag 100.

Figure 7:
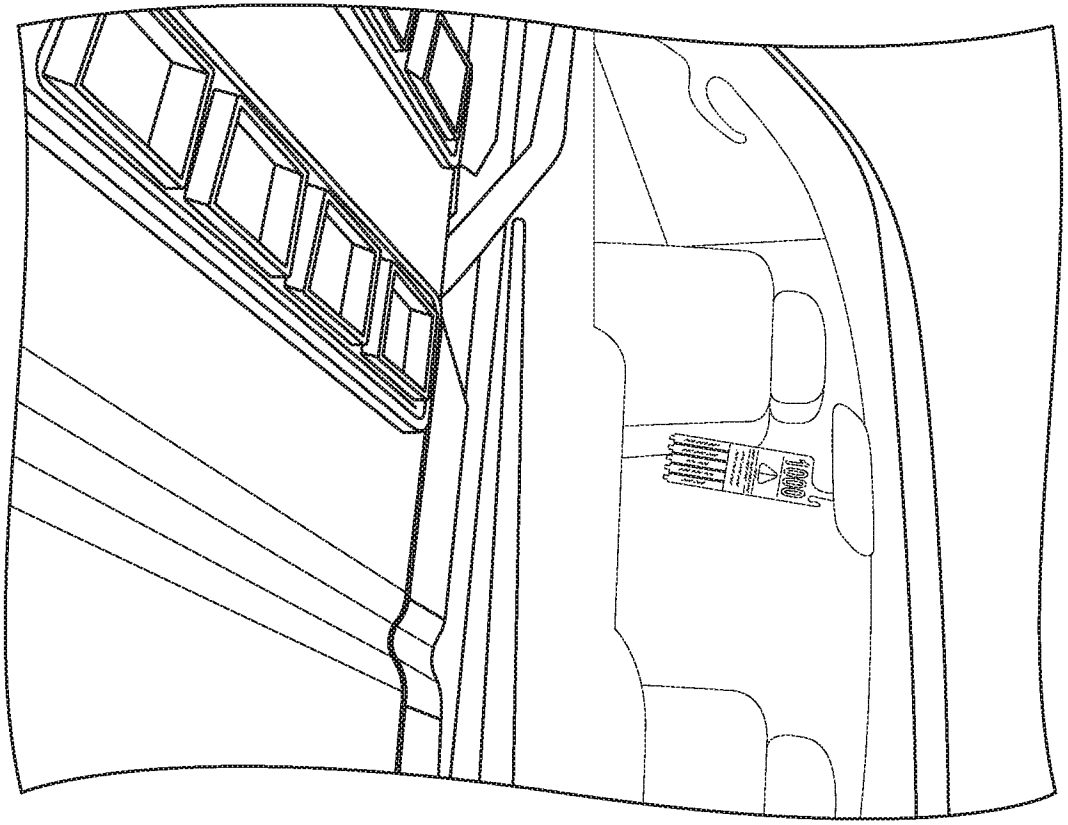
FIGS. 7-8 illustrate an automotive service tag used to implement methods in accordance with an embodiment of the present invention.
Figure 8:
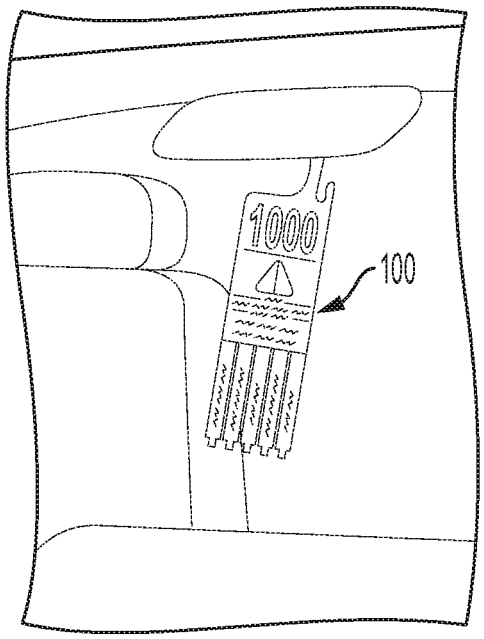

In another embodiment (not shown), a method of using the automotive service tag 100 when a vehicle is serviced is described. The method includes the steps of providing an automotive service tag 100 as described above, and hanging the automotive service tag 100 with an identifier 112 on the rear-view mirror of the vehicle using the hanger portion 118, as shown in FIGS. 7-8. A key tag having the same identifier 112 as the automotive service tag 100 is hanged on the protrusion (key tag male portion) 116 of the automotive service tag 100, as shown in FIG. 6. Plurality of services that need to be performed on the vehicle are identified, and the vehicle is readied for service by folding the plurality of foldable tags 152A-N for services that do not need to be performed by inserting the male portion 154A-N of the foldable tag into the corresponding female portion 114A-N in the upper portion 110. The service described in each of the plurality of foldable tags 152A-N is performed and subsequent to performance of each such described service, the corresponding foldable tag is folded by inserting the male portion 154A-N of the foldable tag into the corresponding female portion 114A-N in the upper portion 110.

In another embodiment (not shown), a method of using the automotive service tag 100 when a vehicle is serviced is described. The method includes the steps of providing an automotive service tag 100 as described above; hanging the automotive service tag 100 with an identifier 112 on the rear-view mirror of the vehicle using the hanger portion 118. A key tag having the same identifier 112 as the automotive service tag 100 is hanged on the protrusion (key tag male portion) 116 of the automotive service tag 100.

Plurality of services that need to be performed on the vehicle are identified, and the vehicle is readied for service by folding the plurality of foldable tags 152A-N for services that do not need to be performed by inserting the male portion 154A-N of the foldable tag into the corresponding female portion 114A-N in the left-side portion. The service described in each of the plurality of foldable tags 152A-N is performed and subsequent to performance of each such described service, the corresponding foldable tag is folded by inserting the male portion 154A-N of the foldable tag into the corresponding female portion 114A-N in the left-side portion.

In another embodiment (not shown), a method of using the automotive service tag 100 when a vehicle is serviced is described. The method includes the steps of providing an automotive service tag 100 as described above; hanging the automotive service tag 100 with an identifier 112 on the rear-view mirror of the vehicle using the hanger portion 118. A key tag having the same identifier 112 as the automotive service tag 100 is hanged on the protrusion (key tag male portion) 116 of the automotive service tag 100.

Plurality of services that need to be performed on the vehicle are identified, and the vehicle is readied for service by folding the plurality of foldable tags 152A-N for services that do not need to be performed by inserting the male portion 154A-N of the foldable tag into the corresponding female portion 114A-N in the right-side portion 450. The service described in each of the plurality of foldable tags 152A-N is performed and subsequent to performance of each such described service, the corresponding foldable tag is folded by inserting the male portion 154A-N of the foldable tag into the corresponding female portion 114A-N in the right-side portion.

Figure 9:
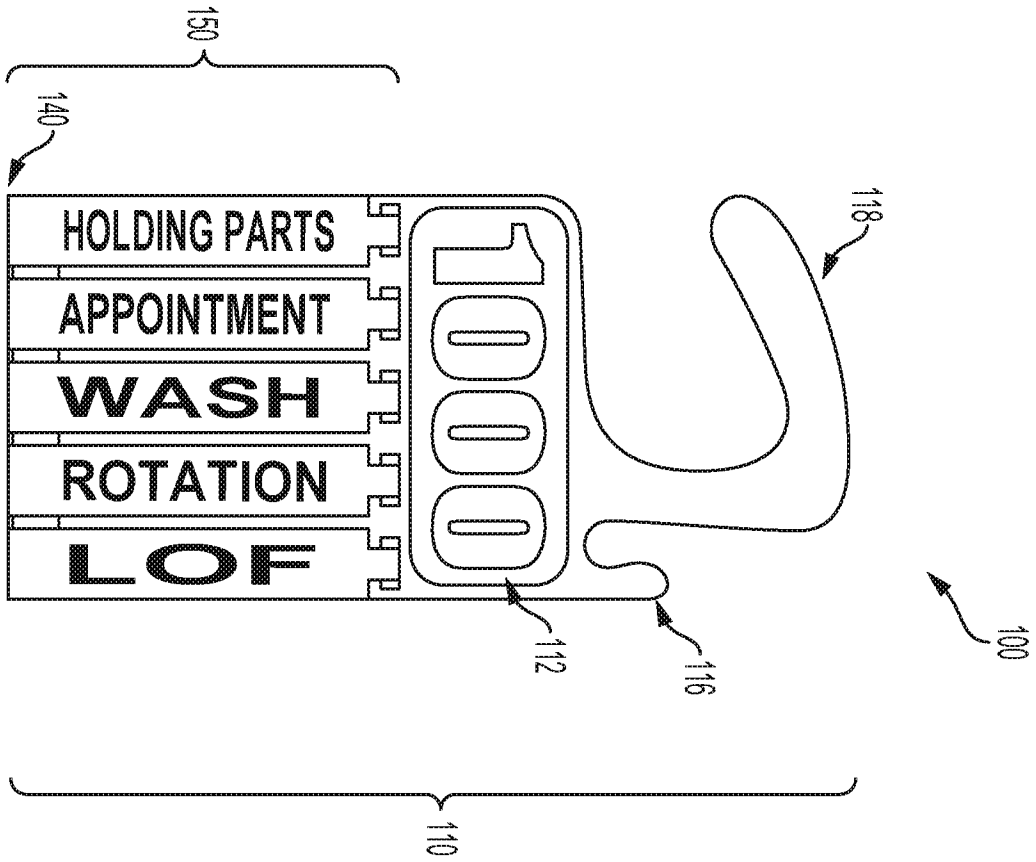
FIG. 9 shows the front side of an automotive service tag in accordance with an embodiment of the present invention.

At the end of the vehicle service, each of the plurality of foldable tags 152A-N appear folded, as shown in FIG. 9, with the male portion 154A-N of each of the plurality of foldable tags 152A-N inserted into the corresponding female portion 114A-N in the upper portion 110 of the automotive service tag 100.

The foldable tags 152A-N may be locked into different positions using other means such as snaps, VELCRO, buttons, tabs, hooks, adhesive (including reusable adhesives), and/or other fastening mechanisms instead of or in addition to using a male portion 154A-N that fits into a female portion 114A-N.

Figure 10A:
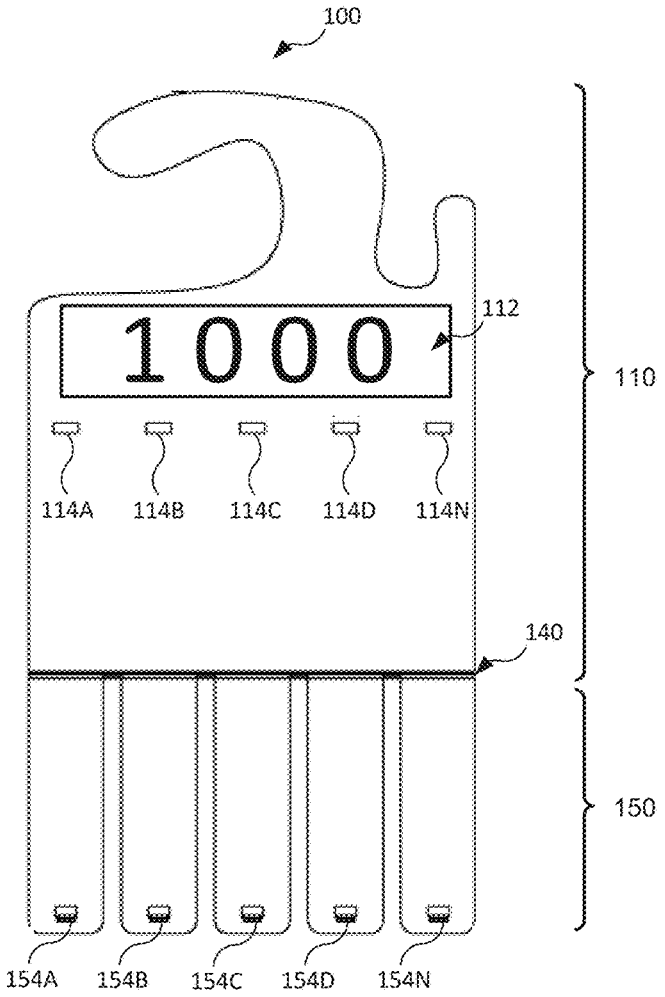
FIG. 10A shows the front side of an automotive service tag in accordance with an embodiment of the present invention.
Figure 10B:
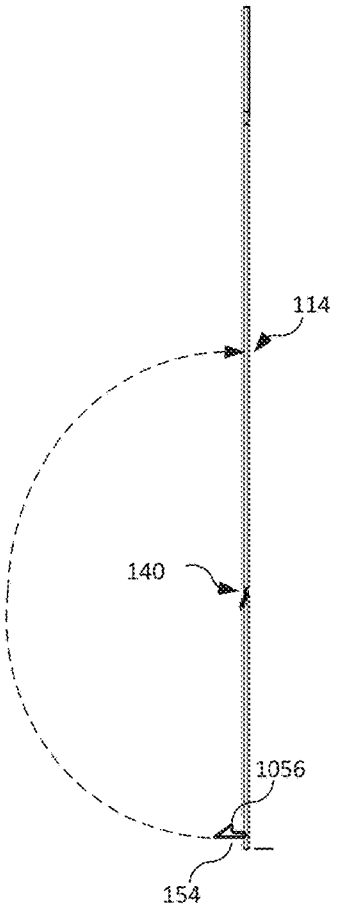
FIG. 10B shows the side view of an automotive service tag in accordance with an embodiment of the present invention.
Figure 10C:
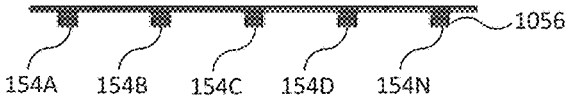
FIG. 10C shows a bottom view of an automotive service tag in accordance with an embodiment of the present invention.

For instance, as illustrated in FIGS. 10A-C, one or more of the foldable tags 152A-N may include a male portion 154A-N configured as a tab having a lip portion 1056 that engages the female portion 114A-N. The lip portion 1056 may ensure a tighter fit and adhesion when the corresponding foldable tag 152 is folded upward to indicate that a service is completed or unneeded.

A reference numeral that appears in more than one figure represents the same component across multiple figures, and may not be described with respect to any one of the figures when repeated.

Although illustrated as being equal in width, some of the foldable tags 152 may be different widths than other ones of the foldable tags 152. For instance, a service deemed to be of higher priority may have a wider (or narrower) corresponding foldable tag 152 than another service. Furthermore, although illustrated as having approximately equal space between the foldable tags 152, the space may be variable or none at all. Furthermore, although described with respect to folding a foldable tag 152 into a female portion signifies that a service is unneeded or complete; the opposite could be true as well. For instance, an unfolded state (i.e., when the male portion 154 is not engaged with the female portion 114 such that the foldable tag is not retained by the upper portion), may indicate that the corresponding service of a foldable tag 152 is complete or unneeded. Thus, the folded or unfolded state of a foldable tag 152 may correspond to a state of a corresponding service, according to particular needs.

The embodiments shown in FIGS. 1-10 are related to the automotive area but it should be understood that the automotive service tag 100 may have applications in other fields including, but not limited to, engineering. While the present invention is described herein with reference to illustrative embodiments for particular applications, it should be understood that the invention is not limited thereto. Those having ordinary skill in the art and access to the teachings provided herein will recognize additional modifications, applications, embodiments and substitution of equivalents all fall within the scope of the invention. Accordingly, the invention is not to be considered as limited by the foregoing description.

What is claimed is:

1. An automotive service tag for a vehicle, the automotive service tag comprising:

a detachable key tag comprising an identifier, a through hole, and a key ring portion configured to hold a key of the vehicle;

a first portion comprising multiple foldable tags each having a respective male portion, wherein each of the multiple foldable tags is associated with one of a set of vehicle services;

a second portion having a top end and comprising the identifier for pairing with the detachable key tag, a hanger portion extending from the top end and configured to hang the automotive service tag on a rear-view mirror of the vehicle, a protrusion extending from the top end and configured to engage with the through hole of the detachable key tag, and multiple female portions each configured to receive a corresponding male portion of a respective one of the multiple foldable tags; and a foldable edge disposed between the first portion and the second portion, wherein each one of the multiple foldable tags is foldable about the foldable edge such that a male portion of a foldable tag folded about the foldable edge engages with a corresponding female portion to retain the foldable tag at the second portion, wherein a foldable tag affixed to the automotive service tag but not retained at the second portion indicates that a corresponding vehicle service associated with the foldable tag has not been completed, and wherein a foldable tag folded about the foldable edge and retained at the second portion indicates that a corresponding vehicle service associated with the foldable tag has been completed or is not needed.

2. The automotive service tag of claim 1, wherein the first portion is disposed at a lower position of the automotive service tag when hung on the rear-view mirror and the second portion is disposed at an upper position of the automotive service tag when hung on the rear-view mirror.

3. The automotive service tag of claim 2, wherein the multiple female portions are located between the top end of the second portion and the foldable edge.

4. The automotive service tag of claim 1, wherein the first portion is disposed at a left position of the automotive service tag when hung on the rear-view mirror and the second portion is disposed at a right position of the automotive service tag when hung on the rear-view mirror.

5. The automotive service tag of claim 1, wherein the first portion is disposed at a right position of the automotive service tag when hung on the rear-view mirror and the second portion is disposed at a left position of the automotive service tag when hung on the rear-view mirror.

6. The automotive service tag of claim 1, wherein each female portion is configured as a through hole, and each male portion has a width that is less than a width of the corresponding foldable tag and is configured to be inserted into the through hole to engage the female portion.

7. The automotive service tag of claim 1, wherein each female portion is configured as a through hole, and each male portion includes a lip portion configured to be inserted into the through hole to releasably clip onto the second portion through the through hole.

8. The automotive service tag of claim 1, the automotive service tag further comprising:

a substantially planar body comprising the first portion, the second portion, and the foldable edge.

9. The automotive service tag of claim 8, wherein the substantially planar body is formed from a reusable material comprising polyethylene or polypropylene.

10. A method of tracking services to be completed on a vehicle using an automotive service tag, the automotive service tag comprising a detachable key tag, a first portion comprising multiple foldable tags each having a respective male portion and each associated with one of a set of vehicle services, a second portion having a top end and comprising multiple female portions each configured to receive a corresponding male portion of a respective one of the multiple foldable tags, and a foldable edge disposed between the first portion and the second portion, wherein each one of the multiple foldable tags is foldable about the foldable edge such that male portions of one or more of the multiple foldable tags folded about the foldable edge engage with corresponding female portions to retain the one or more foldable tags at the second portion, wherein a foldable tag affixed to the automotive service tag but not retained at the second portion indicates that a first vehicle service of the set of vehicle services has not been completed, the method comprising:

hanging the automotive service tag onto the rear-view mirror of the vehicle via a hanger portion extending from the top end of the second portion;

attaching a key of the vehicle onto the detachable key tag, the detachable key tag comprising a through hole, and a key ring portion configured to hold the key of the vehicle;

attaching the detachable key tag onto a protrusion extending from the top end of the second portion, wherein the protrusion is configured to engage with the through hole of the detachable key tag;

performing the first vehicle service, wherein the foldable tag not retained at the second portion is associated with the first vehicle service; and responsive to completion of the first vehicle service, folding the foldable tag about the foldable edge such that a male portion of the foldable tag engages with a corresponding female portion at the second portion to retain the foldable tag at the second portion, wherein folding the foldable tag about the foldable edge such that the foldable tag is retained at the second portion indicates that the first vehicle service has been completed.

11. The method of claim 10, wherein the detachable key tag comprises an identifier, and wherein the second portion further comprises the identifier for pairing with the detachable key tag, the method further comprising:

identifying the key of the vehicle based on the identifier of the detachable key tag attached to the key and the identifier of the second portion of the automotive service tag hanging onto the rear-view mirror of the vehicle.

12. The method of claim 10, the method further comprising:

identifying a first portion of the set of vehicle services comprising one or more services that need to be performed on the vehicle, the identified first portion including at least the first vehicle service, wherein the one or more services that need to be performed on the vehicle correspond to a first subset of the multiple foldable tags, the first subset of the multiple foldable tags including at least the foldable tag associated with the first vehicle service;

determining a second portion of the set of vehicle services comprising one or more services that do not need to be performed on the vehicle based on the identified first portion, wherein the one or more services that do not need to be performed on the vehicle correspond to a second subset of the multiple foldable tags;

folding the second subset of the multiple foldable tags about the foldable edge such that male portions of the second subset of the multiple foldable tags folded about the foldable edge engage with corresponding female portions to retain the second subset of the multiple foldable tags at the second portion; and hanging the automotive service tag onto the rear-view mirror of the vehicle with the first subset of the multiple foldable tags unfolded and not retained at the second portion, and the second subset of the multiple foldable tags retained at the second portion, wherein the second subset of the multiple foldable tags retained at the second portion indicate that the second portion of the set of vehicle services do not need to be performed on the vehicle.

* * * * *